United States Patent [19]

Steinhilber

[11] Patent Number: 4,865,403

[45] Date of Patent: Sep. 12, 1989

[54] FOLDING STANDUP DESK

[76] Inventor: Helmut Steinhilber, Vorrutiweg 12, 6052 Hergiswil, Switzerland

[21] Appl. No.: 174,411

[22] Filed: Mar. 28, 1988

[30] Foreign Application Priority Data

Mar. 27, 1987 [DE] Fed. Rep. of Germany ..... 3710121

[51] Int. Cl.[4] ..... A47B 17/00

[52] U.S. Cl. ..... 312/196; 312/195; 312/323

[58] Field of Search ..... 312/196, 194, 195, 317 R, 312/317 A, 323; 108/69, 70, 137, 143, 90

[56] References Cited

U.S. PATENT DOCUMENTS

| | | | |
|---|---|---|---|
| 472,826 | 4/1982 | Rudrof | 312/317 R |
| 3,711,174 | 1/1973 | Davis et al. | 312/194 |
| 4,111,506 | 9/1978 | Gorkiewiez | 312/194 |
| 4,736,689 | 4/1988 | Stanko | 108/143 X |
| 4,755,009 | 7/1988 | Price et al. | 312/194 |

FOREIGN PATENT DOCUMENTS

| | | |
|---|---|---|
| 49504 | 2/1889 | Fed. Rep. of Germany . |
| 59420 | 4/1891 | Fed. Rep. of Germany . |
| 1953194 | 9/1931 | Fed. Rep. of Germany . |
| 66157 | 11/1891 | Fed. Rep. of Germany . |
| 2180158 | 9/1908 | Fed. Rep. of Germany . |
| 7510211 | 8/1975 | Fed. Rep. of Germany . |
| 7640777 | 4/1978 | Fed. Rep. of Germany . |
| 998339 | 4/1963 | United Kingdom . |

*Primary Examiner*—Joseph Falk

*Attorney, Agent, or Firm*—Mason, Fenwick & Lawrence

[57] ABSTRACT

In order to be able to retrofit an existing writing desk in simple fashion with a standup desk that can be folded and slid beneath the working surface of the writing desk, the standup desk has a frame on which the guides for sliding the standup desk are provided. This frame can be placed as a free-standing bracket beneath the writing desk or tensioned between the pedestals of the writing desk or between the floor and the working surface.

10 Claims, 3 Drawing Sheets

FOLDING STANDUP DESK

The invention relates to a folding standup desk.

Prolonged seated activity at a writing desk is frequently perceived as uncomfortable and is also especially disadvantageous for health reasons. It is therefore advantageous to interrupt the seated activity at intervals by standing activity at a standup desk. A standup desk placed next to the writing desk for this purpose takes up additional space. It is known that the standup desk can be made to fold, so that it can be folded up and put away when it is not needed to save space.

According to applicant's prior patent application Ser. No. 129,735 filed December 7, 1987, entitled "DESK WITH AN ADDITIONAL LECTERN", upon which U.S. Pat. No. 4,802,714 issued on February 7, 1989, the stand-up desk can be slid, in the folded state, into guides beneath the work surface of a writing desk. The standup desk, which is beneath the work surface of a writing desk. The standup desk, which is beneath the work surface when not in use, takes up no space. If needed, it can be pulled out simply by reaching beneath the work surface and bringing it into its operating position, in which it projects above the work surface of the writing desk. The space-saving arrangement of the folded standup desk beneath the work surface of the writing desk and the arrangement of the standup desk above the work surface of the writing desk in the operating position allows the standup desk to be used in conjunction with any writing desk independently of the other space conditions and what surrounds the desk. The fact that the standup desk can be simply pulled out and folded up into the operating position using one hand, and the fact that it can be equally simply slid back into the resting position beneath the work surface make the operation of the standup desk so convenient that it is in fact used more frequently to alternate between seated and standing activity.

In order to slide the standup desk into its resting position beneath the work surface of the writing desk, and to pull it out from this resting position, guides are provided beneath the work surface. If an existing writing desk is to be retrofitted with a standup desk, the fastening of the guides may sometimes pose difficulties. Fastening the guides using screws is not only tedious, since the writing desk as a rule must be laid on its side, but also requires suitable tools and appropriate skills.

When the guides are screwed, for example, to the pedestals of a writing desk, the screws may interfere with the central locking mechanism or the drawers. In addition, the side walls of the pedestals may be too weak to ensure secure fastening of the guides by screws.

An object of the invention is to provide a folding standup desk which can be slid into guides beneath the work surface of a writing desk when in the resting position, such that an existing writing desk can be easily equipped or retrofitted with the standup desk.

The standup desk according to the invention has a separate frame which carries guides in which the top of the standup desk, together with the legs supporting it, are slid beneath the working surface of the writing desk. When an existing writing desk is retrofitted with the standup desk, therefore, the guides need not be screwed to the writing desk.

In one embodiment of the invention, the frame can be a bracket beneath the working surface of the writing desk, which leaves sufficient knee room for the user of the writing desk. In this embodiment the standup desk is completely independent of the writing desk, so that no fastening means of any sort are required. The standup desk can be pulled out from under the writing desk at any time and placed, for example, beneath another writing desk when necessary.

In another embodiment, suitable for writing desks, with two side pedestals, the frame has two frame parts parallel to and supporting the guides, said frame parts being placed against the side walls of the pedestals beneath the working surface. The frame parts are connected by a cross member whose length is adjustable to allow spreading the frame parts apart, thus applying an expansive force to the frame between the pedestals. This embodiment has the advantage that the frame has no feet and hence can be located practically completely invisibly beneath the work surface of the desk.

Spreading the frame parts apart allows the frame to be adjusted to different distances between the pedestals in different types of writing desks. If a greater degree of adjustability of the spacing between the frame parts is provided for adaptation to different types of desks, the vertical legs supporting the top of the standup desk can be provided with a linearly adjustable cross member, which can be adjusted to the different distances between the guides mounted on the frame parts.

If the writing desk has no pedestals, according to another embodiment of the invention the frame can be located so that it is in compression between the floor and the working surface of the writing desk. The two frame parts supporting the guides are for this purpose pressed from below against the working surface by means of height-adjustable feet, so that the frame is held in a stable position by expansive force against the writing desk. Since the frame parts extend for a certain distance in the direction of the guides to fasten the guides in place, as a rule a single foot suffices to compress all the frame parts. To secure the feet and hence the frame from tilting crosswise with respect to the guides, the frame parts in this embodiment as well can be connected by a cross member, said member of course not having to be adjustable lengthwise. If the frame parts themselves have a sufficient extent crosswise with respect to the guides, e.g., if they are in the form of rectangular plates, they will themselves provide sufficient support for the feet against tipping, so that a cross member connecting the frame parts is not required.

In writing desks with only one side pedestal, a design is also possible in which one frame part is compressed between the floor and the working surface by means of a height-adjustable foot, while the other frame part is compressed laterally against the pedestal by a length-adjustable cross member.

In those embodiments in which the frame parts are compressed by expansive force against pedestals or against the working surface, an adhesive layer is advantageously provided between the frame parts and the pedestals or the working surface. This adhesive layer can be formed by a plastic coating on the corresponding areas of the frame parts, by advantageously self-adhesive rubber-like plates or other known means. The adhesive layer promotes reliable locking of the frame parts to the writing desk without high-pressure forces being required for tensioning. Particularly in embodiments in which the frame has feet, the forces acting on the standup desk when it is in use are transferred nearly completely to the frame feet, so that the fastening of the frame parts to the writing desk must take up only slight displacement forces as the folded standup desk is slid in and out. The adhesive layer can absorb these slight displacement forces reliably even when the frame parts exert only slight pressure.

If the frame parts have a sufficient length in the direction of the guides, the guides can also possibly be provided in the frame parts themselves. Advantageously, the guides are telescoping tracks in which running rails are mounted, to which the vertical legs of the standup desk are pivotably attached. If the telescoping tracks have sufficient rigidity of their own, said tracks can also be used as frame parts themselves. For reasons of stability, however, the frame is made as a rule from rectangular steel tubing, with conventional telescoping tracks being mounted on the frame parts.

The invention will now be described in greater detail with reference to the embodiments shown in the drawings.

Figure 1:
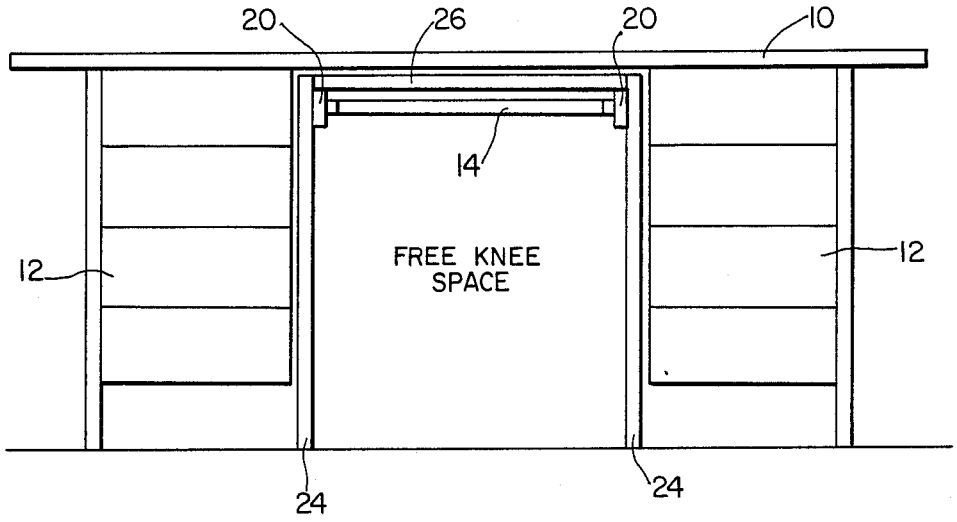
FIG. 1 is a front elevation of a writing desk with a standup desk according to a first embodiment.

The standup desk shown in the various embodiments is constructed for retrofitting a conventional writing desk with a working surface 10 and possibly with side pedestals 12.

The standup desk has a top 14 supported by legs 16. Legs 16 are fastened pivotably to rails 18. Rails 18 are displaceably guided by roller bearings in telescoping tracks 20. Telescoping tracks 20 are disposed in the manner described hereinbelow on the underside of the working surface 10 on both sides of the kneehole of the writing desk.

In the position shown in the drawing, the standup desk is folded and slid into its resting position beneath working surface 10 of the writing desk. Rails 18 are located at the rearward end of telescoping tracks 20, away from the user of the writing desk. Legs 16 are flush with the rails and the top 14 is aligned flush with legs 16 as well, so that the top is held beneath wokring surface 10 and is parallel thereto. Top 14 then rests on supports, not shown. When the standup desk is in this resting position, the writing desk can be used in the ordinary way.

In order to use the standup desk rather than the writing desk, it is pulled out from beneath working surface 10, whereupon rails 18 in telescoping tracks 20 slide forward toward the user. When rails 18 are at the forward ends of telescoping tracks 20, legs 16 can be swung into vertical positions and desk top 14 tilted into an inclined position against legs 16, in which position it projects over working surface 10 of the writing desk. The user can then work at the standup desk without having to clear away working surface 10. In order to be able to resume working on the writing desk, the process is reversed and the standup desk slid back under working surface 10 into the resting position shown in the drawing.

The several embodiments described below relate to the fastening of the guides beneath the writing desk. The desk top and the legs supporting it can be constructed in different ways.

Figure 2:
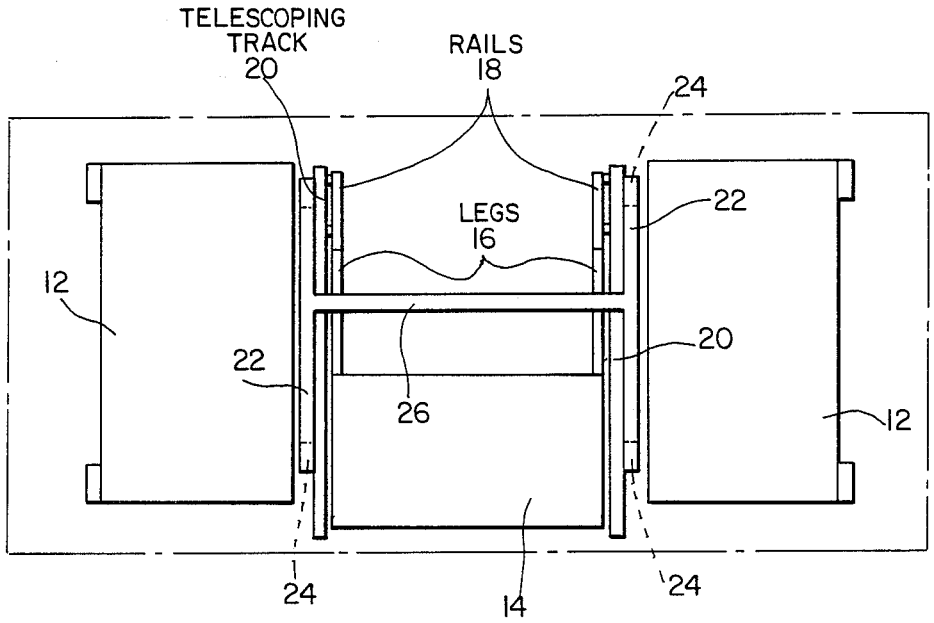
FIG. 2 is a top view of the writing desk and standup desk in FIG. 1.

In the embodiment shown in FIGS. 1 and 2, telescoping tracks 20 serving as guides are fastened to a frame designed as a freestanding bracket. The bracket has two horizontal frame parts 22, each of which is supported by two feet 24 and connected together by a cross member 26. The bracket is made entirely from rectangular steel tubing. Telescoping tracks 20 are fastened to the bracket beneath cross member 26.

The dimensions of the bracket are selected so that frame parts 22 and cross member 26 are located immediately beneath working surface 10 and frame parts 22 and feet 24 are located laterally directly on pedestals 12. In this way, the bracket and standup desk do not significantly restrict the free knee room of the user of the writing table. Since the bracket is designed to be freestanding, it can be placed beneath any writing desk whose dimensions do not differ significantly from standard dimensions. Of course the bracket can also be placed beneath a writing desk without pedestals 12.

Cross member 26 can also be located beneath telescoping tracks 20, this having the advantage that the inserted desk top 14 is located closer to working surface 10 and is hence less visible, and has less of a negative effect on the available knee room.

Figure 3:
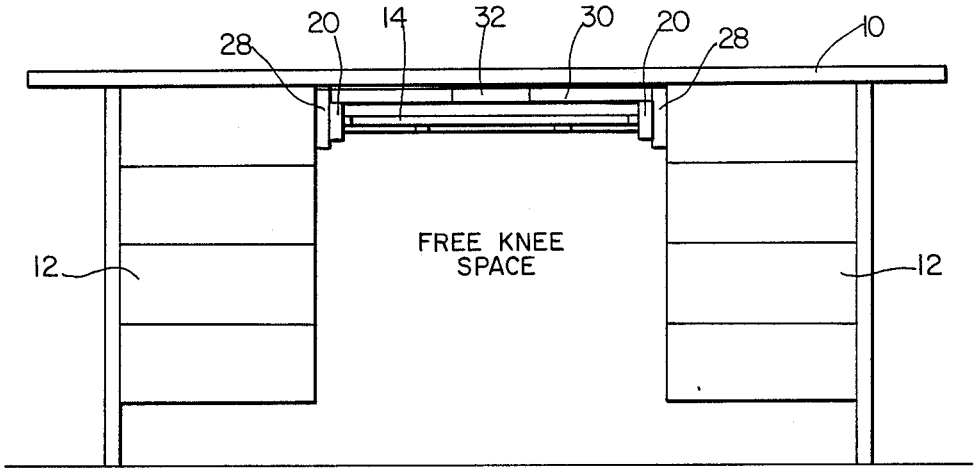
FIG. 3 is a front elevation of a writing desk with a standup desk according to a second embodiment.
Figure 4:
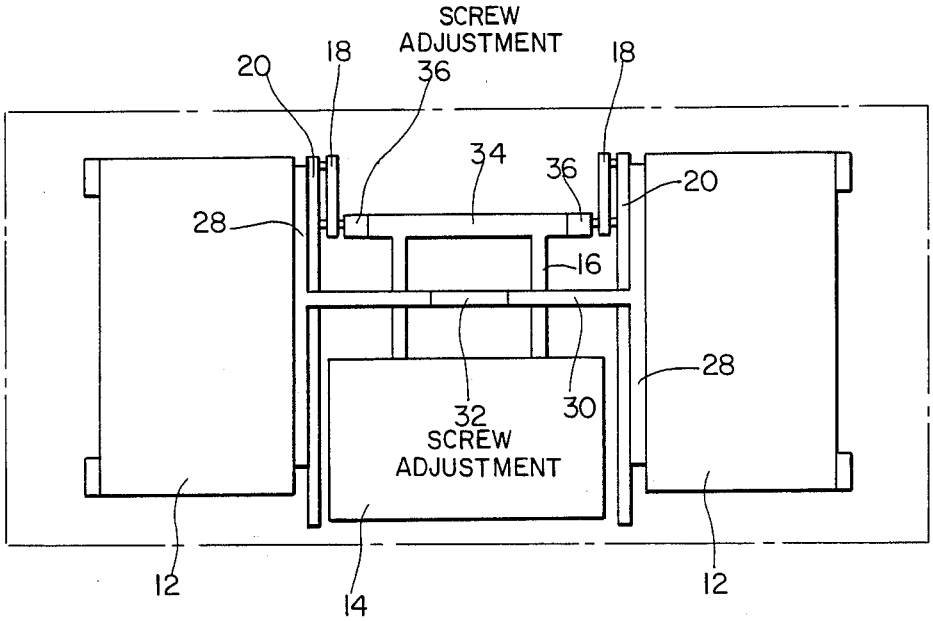
FIG. 4 is a top view of the writing desk and standup desk according to FIG. 3.

The embodiment shown in FIGS. 3 and 4 is suitable only for a writing desk with pedestals 12.

In this embodiment, the frame consists of two frame parts 28 connected by a cross member 30. Cross member 30 is adjustable lengthwise by means of a suitable device, e.g. a screw adjustment 32. Frame parts 28 are located laterally on pedestals 12 beneath working surface 10 and are spread apart by adjusting the length of cross member 30, so that the frame is expanded to be under compression between pedestals 12. Lengthwise adjustment of cross member 30 allows the frame to be adjusted in this manner for different distances between pedestals 12 in different writing desks.

As the length of cross member 30 changes, so does the spacing of telescoping tracks 20 mounted on frame parts 28, as well as that of rails 18 guided in said tracks. For this reason, legs 16 supporting top 14 are not fastened directly to rails 18, but connected to rails 18 by cross member 34 which is adjustable lengthwise. The length adjustment of cross member 34 can also be made by screw adjustments 36, for example.

An adhesive layer is provided on the outer surfaces of frame parts 28 which abut pedestals 12, said parts consisting of rectangular steel tubing, said layer being for example in the form of rubber-like plates self-adhesive on one or both sides. This adhesive layer ensures reliable attachment of the frame.

Figure 5:
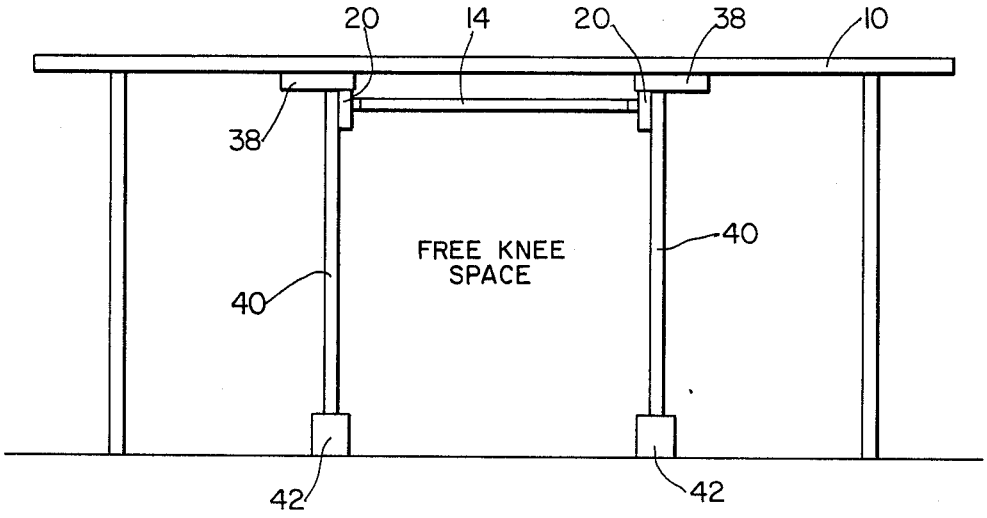
FIG. 5 is a front elevation of a writing desk with a standup desk according to a third embodiment.
Figure 6:
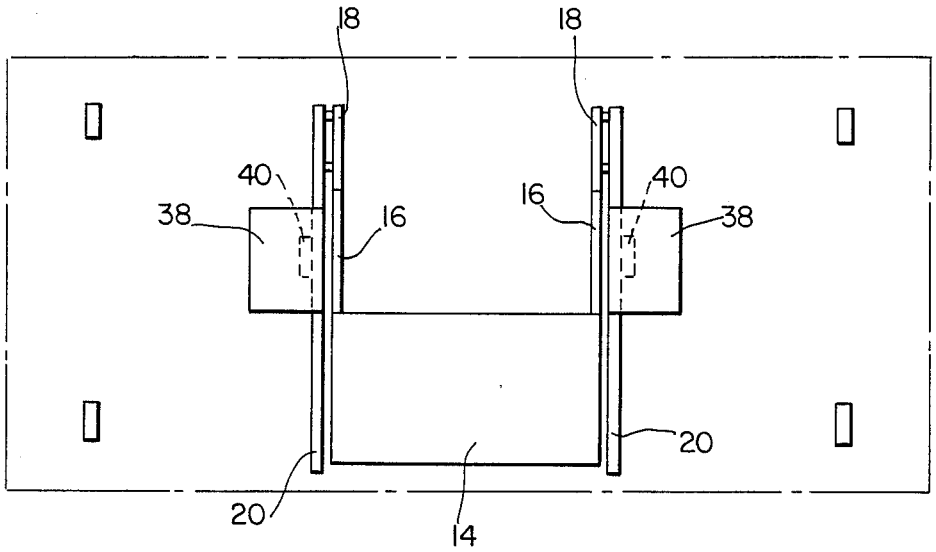
FIG. 6 is a top view of the writing desk and standup desk in FIG. 5.

FIGS. 5 and 6 show an embodiment which can be used even in writing desks without pedestals or with only one pedestal.

Frame parts 38 are designed as rectangular plates having an essentially centrally located foot 40, said foot being adjustable heightwise by means of a screw adjustment 42, for example. Height adjustment of foot 40 presses frame parts 38 against the underside of working surface 10, compressing them against the latter. The areawise extent of frame parts 38 then provides sufficient support for foot 40 to prevent tipping. Frame parts 38 can also be linked additionally by a cross member, not shown. Telescoping tracks 20 are fastened to frame parts 38.

An adhesive layer, for example in the form of a self-adhesive rubber-like plate, is provided on the upper surface of frame parts 38 which come in contact with working surface 10.

I claim:

1. In combination with a desk comprising a desk top and first and second spaced elements therebelow for supporting said desk top above a floor and having a knee-hole between them, a folding stand-up desk comprising:

frame means between said elements in said knee-hole for exerting an expansive force thereon for fixing said frame means therebetween, a stand-up desk top, means for supporting said stand-up desk top in a position above said desk top of said desk, and means extending horizontally beneath said desk top of said desk for slidably mounting said stand-up desk top and said means for supporting on said frame means for movement of said stand-up desk top between a position underlying and parallel to said desk top of said desk and said position above said desk top of said desk.

2. The combination of claim 1, said mounting means comprising tracks supported by said frame means, rails slidable in said tracks, and means for connecting said rails to said stand-up desk top.

3. The combination of claim 1, said frame means comprising first and second frame members each bearing on a said element and a cross member extending between said frame members, said cross member comprising means for adjusting the length thereof.

4. The combination of claim 3, said means for supporting comprising leg means connected to said stand-up desk top for supporting said stand-up desk top in said position above said desk top of said desk, said means for slidably mounting said stand-up desk top comprising means for slidably mounting said legs.

5. The combination of claim 3, and further comprising adhesive means between each said frame member and the adjacent element for locking said frame member to said desk.

6. In combination with a desk comprising a desk top having an underside and means for supporting said desk top above a floor, a folding stand-up desk comprising:

frame means extending between the underside of said desk top and the floor therebeneath for exerting an expansive force therebetween for fixing said frame means therebetween, a stand-up desk top, means for supporting said stand-up desk top in a position above said desk top of said desk, and means extending horizontally beneath said desk top of said desk for slidably mounting said stand-up desk top on said frame means for movement between a position underlying and parallel to said desk top of said desk and said position above said desk top of said desk.

7. The combination of claim 6, wherein said frame means comprises first and second spaced frame members, said mounting means extending between said frame members.

8. The combination of claim 7, said frame means comprising plates having substantial horizontal extent engaging the underside of said desk top.

9. The combination of claim 8, and adhesive means between each said plate and the underside of said desk top for locking said frame means to the underside of said desk top.

10. In combination with a desk adapted to rest on a floor and having a desk top and means for supporting said desk top above the floor, said supporting means providing a knee-hole beneath said desk top, said desk comprising at least one element capable of resisting an expansive force, a folding stand-up desk comprising:

a stand-up desk top, means for supporting said stand-up desk top in a position above said desk top of said desk, means for slidably mounting said stand-up desk top and said means for supporting for movement to and from a position in said knee-hole beneath and substantially parallel to said desk top of said desk, said stand-up desk top being movable between said positions, and means for fastening said stand-up desk top supporting and guiding means in position beneath said desk top of said desk free of fasteners such as screws comprising means for applying an expansive force between fixed elements, at least one said element being a part of

* * * * *

UNITED STATES PATENT AND TRADEMARK OFFICE

CERTIFICATE OF CORRECTION

PATENT NO. : 4865403

DATED : September 12, 1989

INVENTOR(S) : Helmut Steinhilber

It is certified that error appears in the above-identified patent and that said Letters Patent is hereby corrected as shown below:

In claim 10, column 6, line 46, text reading "said element being a part of" should read --said element being a part of said desk and the other said element being a second part of said desk or the floor.--

Signed and Sealed this

Sixth Day of November, 1990

*Attest:*

HARRY F. MANBECK, JR.

*Attesting Officer*

*Commissioner of Patents and Trademarks*